US009551264B1

(12) United States Patent
Langenfeld et al.

(10) Patent No.: US 9,551,264 B1
(45) Date of Patent: Jan. 24, 2017

(54) EXHAUST ARRANGEMENTS FOR MARINE PROPULSION DEVICES

(71) Applicant: Brunswick Corporation, Lake Forest, IL (US)

(72) Inventors: Gregg D. Langenfeld, Fond du Lac, WI (US); David J. Hilbert, Black Creek, WI (US)

(73) Assignee: Brunswick Corporation, Lake Forest, IL (US)

( * ) Notice: Subject to any disclaimer, the term of this patent is extended or adjusted under 35 U.S.C. 154(b) by 23 days.

(21) Appl. No.: 14/521,815

(22) Filed: Oct. 23, 2014

(51) Int. Cl.
*F01N 3/04* (2006.01)
*F01N 13/00* (2010.01)
*F01N 3/20* (2006.01)

(52) U.S. Cl.
CPC ..... *F01N 13/004* (2013.01); *F01N 3/20* (2013.01); *F01N 2590/021* (2013.01)

(58) Field of Classification Search
CPC ..... F01N 13/004; F01N 3/20; F01N 2590/021
See application file for complete search history.

(56) References Cited

U.S. PATENT DOCUMENTS

| | | | |
|---|---|---|---|
| 5,239,825 | A | 8/1993 | Shibata |
| 5,546,748 | A | 8/1996 | Iwai et al. |
| 5,548,955 | A | 8/1996 | Sandefur et al. |
| 5,916,132 | A | 6/1999 | Yoshida et al. |
| 6,338,826 | B2 | 1/2002 | Yamada |
| 7,954,314 | B1 | 6/2011 | Bruestle et al. |
| 8,136,350 | B2 | 3/2012 | Duch et al. |
| 8,246,330 | B2 | 8/2012 | Ay et al. |
| 8,298,026 | B2 | 10/2012 | Ochiai |
| 8,444,447 | B2 | 5/2013 | Ochiai |
| 8,668,538 | B1 | 3/2014 | Langenfeld et al. |
| 2001/0024627 | A1 | 9/2001 | Nilsson |
| 2003/0064643 | A1 | 4/2003 | Takahashi |
| 2003/0074887 | A1 | 4/2003 | Watkins et al. |
| 2009/0020275 | A1* | 1/2009 | Neher ..... F02M 25/0737 165/170 |
| 2009/0215333 | A1 | 8/2009 | Ochiai |
| 2010/0240269 | A1 | 9/2010 | Ochiai |
| 2010/0240270 | A1 | 9/2010 | Ochiai |
| 2013/0130577 | A1* | 5/2013 | Ochiai ..... F01N 3/28 440/89 R |

FOREIGN PATENT DOCUMENTS

| | | |
|---|---|---|
| CN | 201220288382 | 3/2013 |
| EP | 2490799 | 7/2013 |

* cited by examiner

*Primary Examiner* — Thomas Denion
*Assistant Examiner* — Brandon Lee
(74) *Attorney, Agent, or Firm* — Andrus Intellectual Property Law, LLP

(57) ABSTRACT

A marine propulsion device and a method of making a marine propulsion device including an internal combustion engine that discharges exhaust gases. The internal combustion engine has first and second castings. A first exhaust flow passage is in the first casting and a second exhaust flow passage is in the second casting. The second exhaust flow passage has a first and second leg that are transversely oriented to each other. A catalyst is disposed in the second exhaust flow passage and configured to treat the exhaust gases. A flow control element is between the first and second flow passages. The flow control element forms a smooth transition that is devoid of edges such that the exhaust gases flow across and are dispersed by the flow control element before being treated by the catalyst.

12 Claims, 8 Drawing Sheets

EXHAUST ARRANGEMENTS FOR MARINE PROPULSION DEVICES

FIELD

The present disclosure relates to marine propulsion devices, and more particularly to exhaust arrangements for marine propulsion devices.

BACKGROUND

The following U.S. Patents are incorporated herein by reference.

U.S. Pat. No. 8,668,538 discloses a marine engine having an exhaust system comprising a cylinder block having first and second banks of cylinders that are disposed along a longitudinal axis and that extend transversely with respect to each other in a V-shape so as to define a valley there between. A catalyst receptacle is disposed in the valley and contains at least one catalyst that treats exhaust gas from the marine engine. An exhaust manifold conveys exhaust gas from the marine engine to the catalyst receptacle. The exhaust manifold has a first port receiving exhaust gas from the first bank of cylinders, a second port receiving exhaust gas from the second bank of cylinders, and a conduit conveying the exhaust gas from the first and second ports to the catalyst receptacle. From the first and second ports to the catalyst receptacle, the conduit only reverses direction once with respect to the longitudinal axis.

U.S. Pat. Nos. 8,444,447 and 8,298,026 disclose an outboard motor including an engine, an exhaust guide, and a catalyst. The engine includes a cylinder and crankshaft. The crankshaft is disposed along a vertical direction. The exhaust guide is arranged to support the engine from below. The catalyst is disposed in an interior of the engine. The engine includes a cylinder body. The cylinder body includes a housing portion arranged to house the catalyst. The cylinder body includes a first exhaust passage that includes an interior of the housing portion. The catalyst is inserted into the housing portion from below and is sandwiched from above and below by the housing portion and the exhaust guide.

U.S. Pat. No. 7,954,314 discloses an engine provided with a cavity so that a catalyst member can be contained within the engine when an engine head portion is attached to an engine block portion. This attachment of the engine head portion and engine block portion, which forms the engine structure, captivates the catalyst member within the cavity without the need for additional brackets and housing structures. The cavity is preferably located above or at the upper regions of first and second exhaust conduits which direct exhaust upwardly from the engine head portion toward the cavity and downwardly from the cavity within the engine block portion. The first and second exhaust conduits are preferably formed as integral structures within the engine head portion and engine block portion.

U.S. Pat. No. 5,916,132 discloses an engine exhaust emission control system in an outboard engine. The exhaust emission control system has a catalyst unit mounted in an engine block exhaust gas passage in the outboard engine. The catalyst unit comprises a catalyst carrier having at least one catalyst element carried therein and a flexible porous bag having at least a portion of the catalyst therein. The catalyst unit is formed to be positioned within the engine block exhaust passage so as to extend there-along and the catalyst unit is removably inserted and detachably mounted in the exhaust gas passage.

U.S. Pat. No. 5,546,748 discloses a number of embodiments of exhaust systems for outboard motors including a combined catalyst bed and exhaust manifold forming member affixed within the cylinder block of the engine so as to be readily detachable for servicing. This combined member is provided with a separate cooling jacket for its cooling.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In certain examples, a marine propulsion device comprises an internal combustion engine that discharges exhaust gases, a driveshaft housing that is located vertically below the engine, and a catalyst that is sandwiched between opposing castings of the device that face each other at a split-line. The exhaust gases flow through the catalyst parallel to the split-line.

In certain examples, the engine comprises a crankcase and the opposing castings are the crankcase and the driveshaft housing. The catalyst can be radially compressed between the opposing castings. In certain examples, the catalyst includes a ceramic element and a matting material that surrounds the ceramic element. In certain examples, the catalyst includes a ceramic or metallic element and a cylindrical container that contains the element such that an air gap exists between the container and the opposing castings. In certain examples, a circumferential protuberance is on the container and separates the container from the opposing castings so as to define the air gap therebetween. The protuberance forms a circumferential seal with the opposing castings. The circumferential seal prevents exhaust gases from bypassing the element. The protuberance provides radial pressure to retain the catalyst in place. In certain examples, a longitudinal flange is on the container and is sandwiched between the opposing castings.

In certain examples, a marine propulsion device includes an internal combustion engine that discharges exhaust gases. The internal combustion engine has first and second castings. A driveshaft housing is located vertically below the engine. A first exhaust flow passage is in the first casting and a second exhaust flow passage is in the second casting. The second flow passage has an upstream first leg that is parallel to the first flow passage, and a downstream second leg that is transversely oriented to the first leg. A catalyst is disposed in the second leg of the second exhaust flow passage and configured to treat the exhaust gases. A flow control element is between the first and second leg of the second exhaust flow passages. The flow control element forms a smooth transition that is devoid of edges such that the exhaust gases flow across and are dispersed by the flow control element before being treated by the catalyst. The second casting can be die cast.

In certain examples, the engine includes a crankcase, a cylinder block, and a cylinder head. The first exhaust flow passage is formed in the cylinder head and the second exhaust flow passage is formed by the crankcase and the driveshaft housing. In this example, the first casting is the cylinder head and the second casting is the crankcase.

In certain examples, a plate carries the flow control element. The plate is sandwiched between the first and second castings and is configured so that the exhaust gases flow through a hole in the plate. The flow control element laterally extends into the second exhaust flow passage.

In certain examples, a method of making a marine propulsion device includes (1) die casting the second casting for an internal combustion engine that discharges exhaust gases, (2) casting a first exhaust flow passage in the first casting and die casting a second exhaust flow passage in the second casting, wherein the second exhaust flow passage has an upstream first leg that is parallel to the first flow passage, and a downstream second leg that is transversely oriented to the first leg, (3) disposing a catalyst in the second exhaust flow passage, the catalyst being configured to treat the exhaust gases, and (4) inserting a flow control element between the first and second exhaust flow passages, the flow control element forming a smooth transition that is devoid of edges between the first and second leg of the second passage such that the exhaust gases flow across and are dispersed by the flow control element before being treated by the catalyst.

In certain examples, an internal combustion engine for a marine propulsion device includes a piston-cylinder that discharges exhaust gases, a first engine casting that defines a first flow passage configured to receive exhaust gases from the piston-cylinder, and a second engine casting that defines a second flow passage configured to receive exhaust gases from the first flow passage and convey the exhaust gases to a catalyst. The second flow passage has an upstream first leg that is parallel to the first flow passage, and a downstream second leg that is transversely oriented to the first leg. An inside corner is between the first and second legs, the second flow passage has an inlet end that is configured to receive exhaust gases from the first flow passage. The first flow passage has an outlet end that is configured to convey exhaust gases to the inlet end of the second flow passage. The outlet end of the first flow passage is sized smaller than the inlet end of the second flow passage so that exhaust gases are directed away from the inside corner as the exhaust gases travel from the outlet end of the first flow passage to the inlet end of the second flow passage. In certain examples, the first engine casting is a cylinder head and the second engine casting is a cylinder block. A catalyst can be disposed in the second flow passage and configured to treat the exhaust gases. The first and second legs together form a smooth outside radius along which the exhaust gases travel, away from the inside corner. The inlet end is sized larger than the outlet end so that the inside corner is located away from flow of exhaust gases, such that the corner does not disrupt the flow of exhaust gases. A stagnant zone is formed immediately downstream of the outlet end. The exhaust gases tend to bypass the stagnant zone.

In certain examples, a method of forming an internal combustion engine for a marine propulsion device includes (1) casting a first engine casting that defines a first flow passage configured to receive exhaust gases from a piston-cylinder, (2) die casting a second engine casting that defines a second flow passage configured to receive exhaust gases from the first flow passage and convey the exhaust gases to a catalyst. The second flow passage has an upstream first leg that is parallel to the first flow passage, and a downstream second leg that is transversely oriented to the first leg. An inside corner is located between the first and second legs. The second flow passage has an inlet end that is configured to receive exhaust gases from the first flow passage. The first flow passage has an outlet end that is configured to exhaust gases to the inlet end of the second flow passage. The outlet end of the first flow passage is sized smaller than the inlet end of the second flow passage so that exhaust gases are directed away from the inside corner as the exhaust gases travel from the outlet end of the first flow passage to the inlet end of the second flow passage.

BRIEF DESCRIPTION OF THE DRAWINGS

Examples of marine propulsion devices are described with reference to the following drawing figures. The same numbers are used throughout the drawing figures to reference like features and components.

DETAILED DESCRIPTION OF THE DRAWINGS

Through research and experimentation, the present inventors have determined that it is desirable to integrate a catalyst into a marine propulsion device in a compact arrangement. In pursuit of this endeavor, the inventors have also determined that it is desirable to retain the catalyst in a housing that is integral to the major metal castings of the device. Further, in order to remain cost effective, the inventors have determined that the addition of the catalyst housing to the castings preferably should not unduly change the manufacturing processes currently used on production parts. Further, the inventors have determined that limitations of the die casting process can create sharp edges in exhaust flow paths that negatively affect efficiency of exhaust flow to the catalyst. The inventors have realized that it would be beneficial to decrease or eliminate these drawbacks. The present disclosure provides features of marine propulsion devices, including outboard motors that resulted from these and other efforts of the inventors.

The present disclosure provides examples of a marine propulsion device 10, which in this example is an outboard motor. As further described herein below, the marine propulsion device 10 includes an internal combustion engine 12 and a catalyst 30 that is sandwiched between two metal castings of the device 10, wherein in certain examples the catalyst 30 is subjected to radial compression. The radial compression is applied during assembly of noted castings and provides a clamping force that efficiently retains the catalyst 30 in place.

Figure 1:
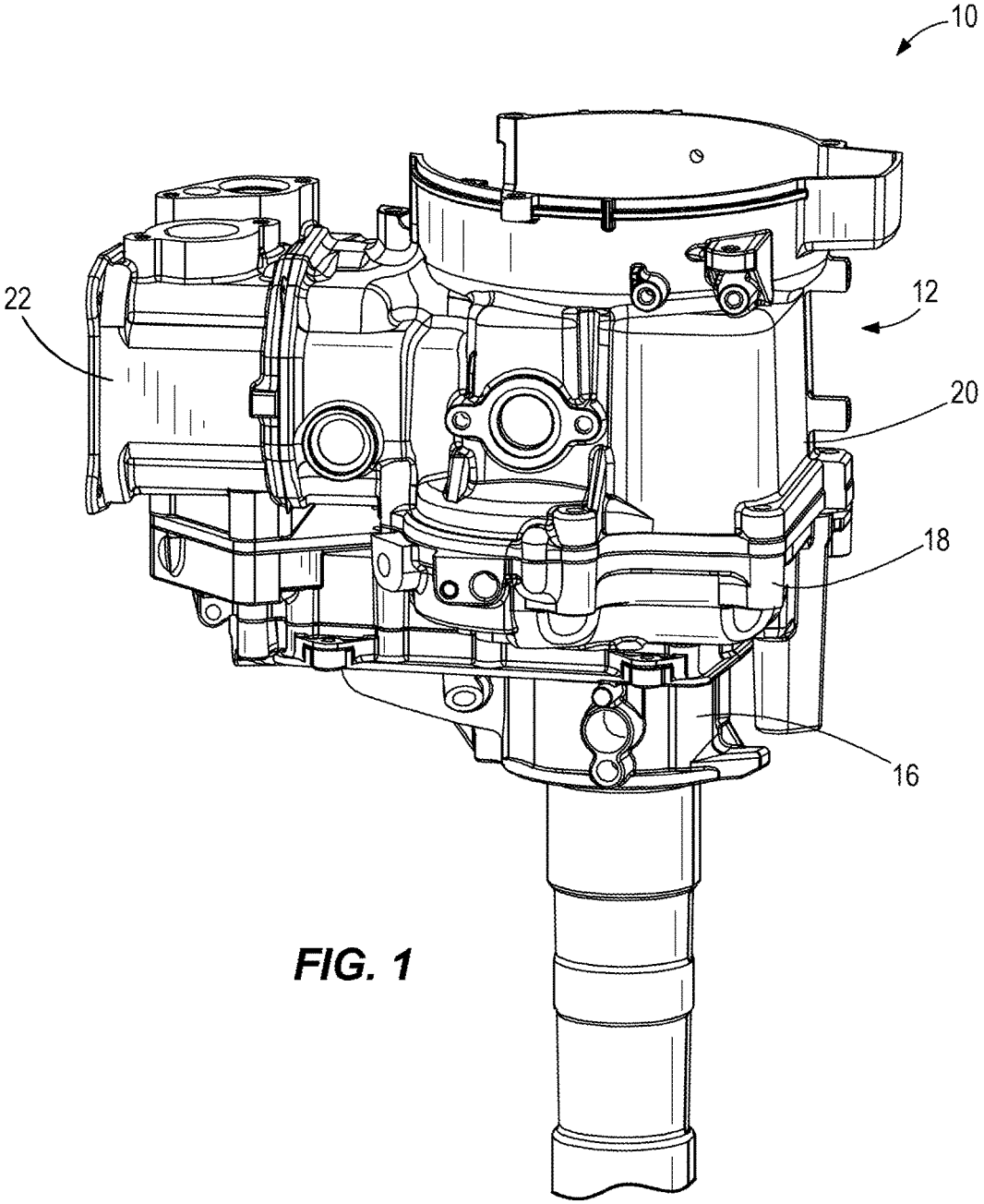
FIG. 1 is a perspective view of portions of a marine propulsion device, including an internal combustion engine and driveshaft housing.
Figure 2:
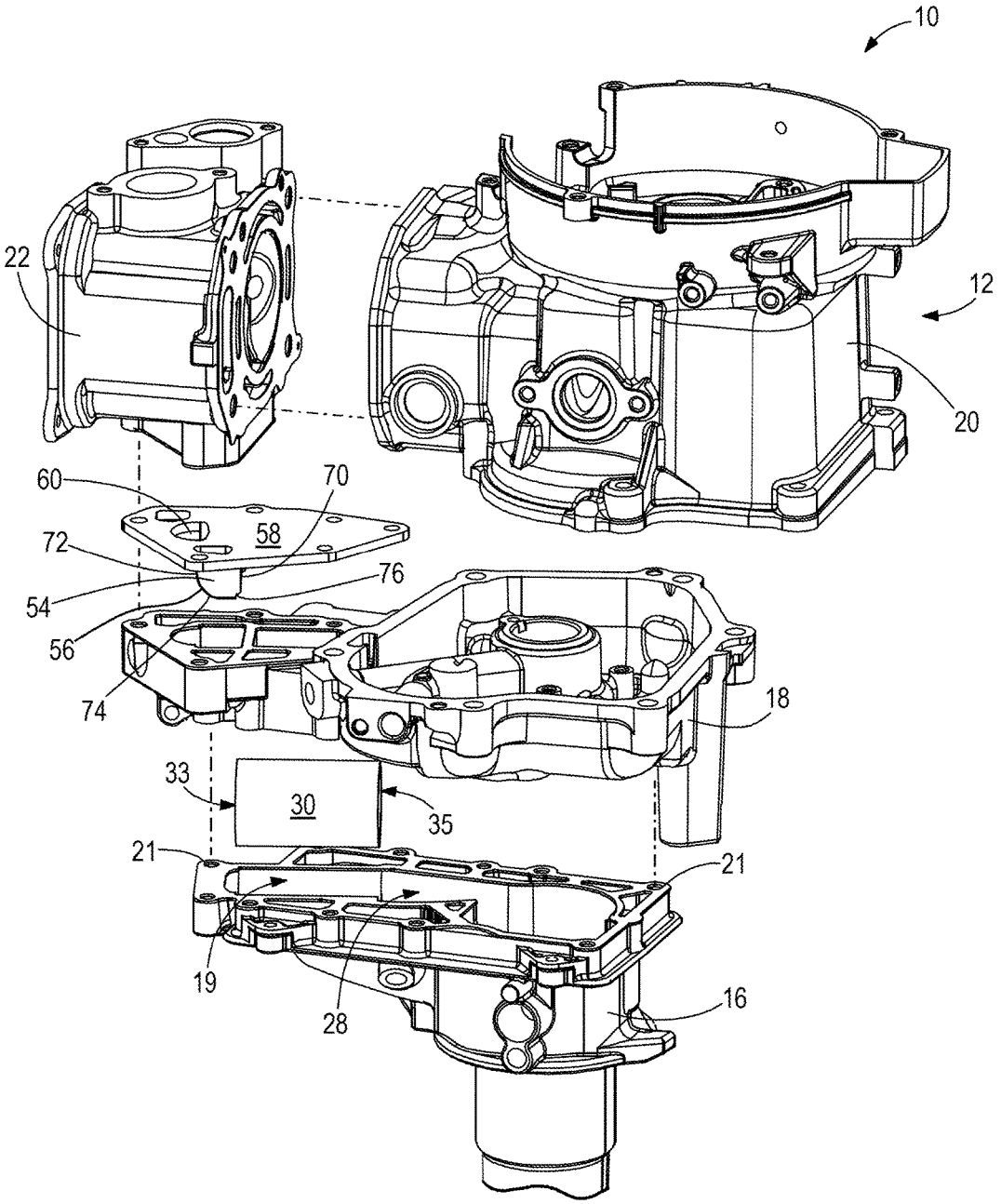
FIG. 2 is an exploded view of the engine and driveshaft housing.
Figure 3:
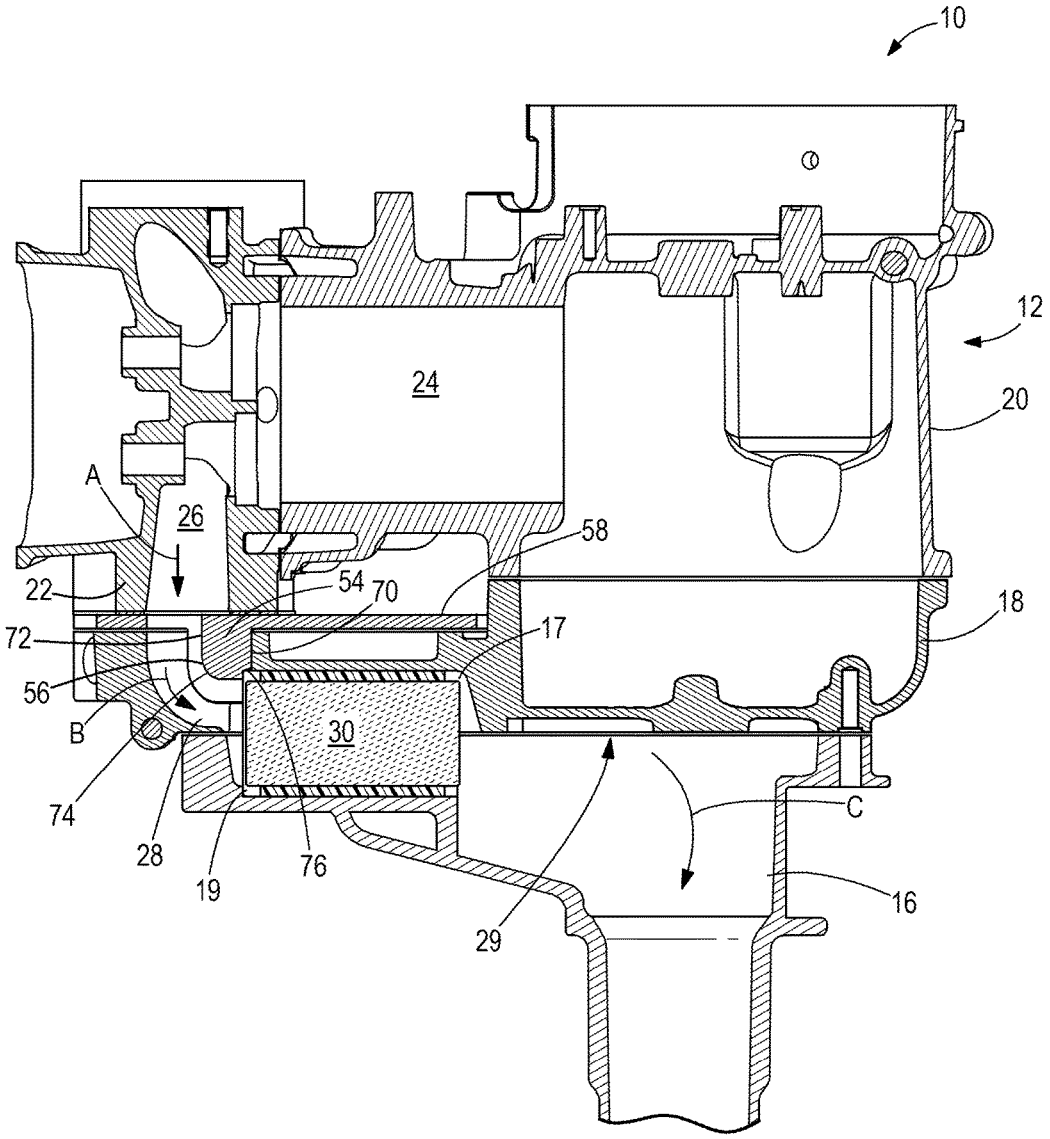
FIG. 3 is a sectional view of the engine and driveshaft housing.

As shown in FIGS. 1-3, the marine propulsion device 10 includes the internal combustion engine 12 and a driveshaft housing 16 that vertically extends below the engine 12 and contains a driveshaft (not shown). The engine 12 includes a plurality of metal castings, including but not limited to a crankcase 18 for housing a crankshaft (not shown), a cylinder block 20 on the crankcase 18, and a cylinder head 22 on the cylinder block 20. The driveshaft housing 16 is also a metal casting and is attached to the crankcase 18. The crankcase 18 and driveshaft housing 16 thus are opposing castings of the device 10 and are separated from each other and face each other at a horizontal split-line 29 (see FIG. 3). Which in this example is horizontal. Each of the metal castings has cooling passages for conveying cooling water therethrough, as is conventional. As such, portions of each of the metal castings is water-cooled.

The cylinder block 20 has at least one piston-cylinder 24 into which air and fuel are supplied for the combustion process. The number of piston-cylinders 24 can vary. In this example a single piston-cylinder 24 is provided. As is conventional, combustion in the piston-cylinder 24 causes reciprocating movement, which in turn causes rotary movement of a crankshaft, thereby causing rotation of the driveshaft that vertically extends from the engine 12 through the driveshaft housing 16. The driveshaft is connected to a propeller via a transmission such that rotation of the driveshaft causes rotation of the propeller. These common structures and functions of an internal combustion engine for causing rotation of a propeller are well known in the art and therefore are not further shown or explained herein.

During the combustion process, exhaust gases are discharged from the piston-cylinder 24 to the cylinder head 22 via one or more conventional exhaust valve(s) (not shown). As shown in FIG. 3, the cylinder head 22 has a vertically extending first flow passage 26 that conveys exhaust gases from the piston-cylinder 24 through the cylinder head 22 to the crankcase 18, see arrow A. The crankcase 18 forms a second exhaust passage that has an upstream first leg that is vertically extending, and forms half of a downstream second leg that is horizontally extending. The crankcase 18 and driveshaft housing 16 together form the horizontally extending second leg of the second flow passage 28 that receives exhaust gases from the first flow passage 26 and horizontally conveys the exhaust gases through the engine 12, in the direction of arrow B. The exhaust gases are discharged from the device 10 via a lower portion of the driveshaft housing 16, see arrow C. Thus the second leg of the second flow passage 28 extends transversely to the first leg of the second flow passage. The crankcase 18 forms a top portion of the second leg of the second flow passage 28 and the driveshaft housing 16 forms a bottom portion of the second leg of the second flow passage 28.

A catalyst 30 is disposed in the second flow passage 28 and is radially compressed between the driveshaft housing 16 and crankcase 18. More specifically, the crankcase 18 has a top cavity 17 that is sized to receive an upper, first portion of the catalyst 30, and the driveshaft housing 16 has a bottom cavity 19 that is sized to receive an opposite, lower, second portion of the catalyst 30. The respective cavities 17, 19 are sized and shaped so that the catalyst 30 is radially compressed by the respective castings 16, 18 when the castings 16, 18 are fixed together via connectors, such as bolts that are received in bolt holes 21. The exhaust gases that flow horizontally through the second flow passage 28 flow horizontally through and are treated by the catalyst 30. The exhaust gases flow into the upstream end 33 of the catalyst 30 and out of the downstream end 35 of the catalyst.

Figure 10:
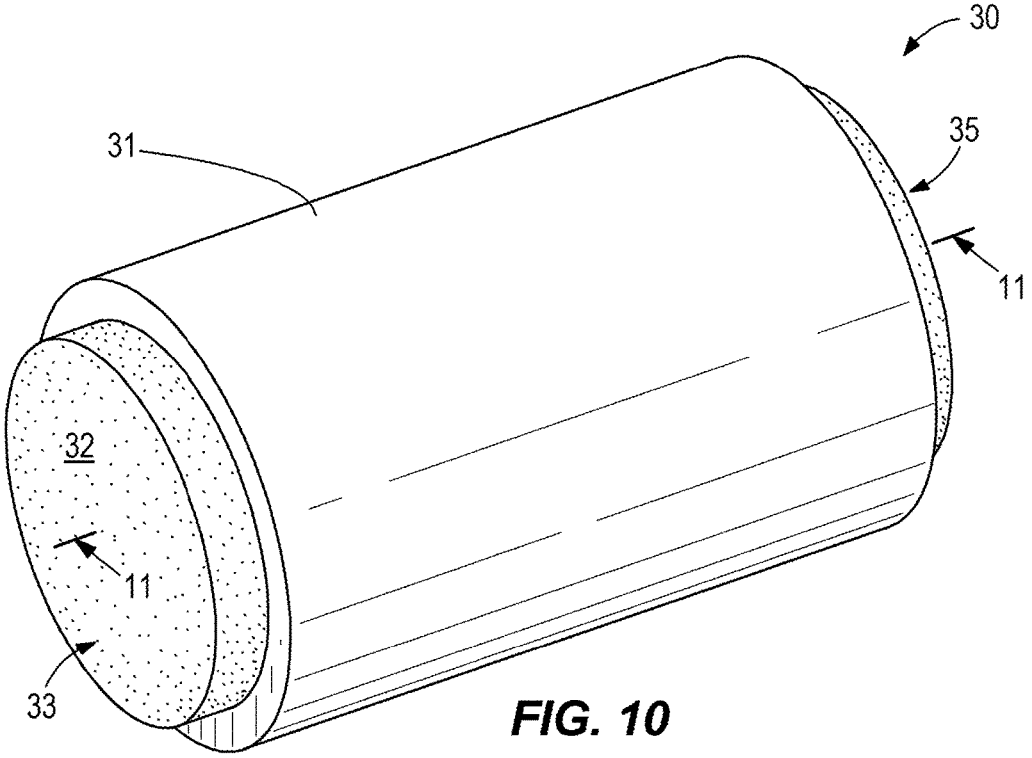
FIG. 10 is a perspective view of another example of a catalyst for treating exhaust from the engine.
Figure 11:
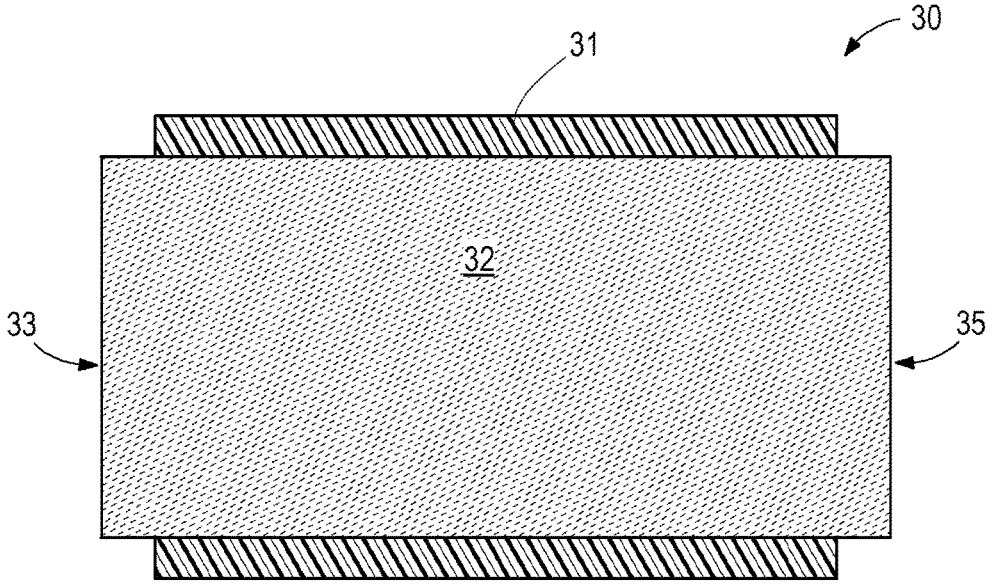
FIG. 11 is a view of section 11-11 taken from FIG. 10.

Referring to FIGS. 10 and 11, in one example the catalyst 30 has a ceramic element 32 that is wrapped in and retained by an insulative matting material 31. The type of matting material can vary and in some examples can include non-intumescent material. The present inventors have found that the above combination of the catalyst 30 having the ceramic element 32 and matting material 31 in the respective cavities 17, 19 in a radially compressed manner, provides packaging and efficiency advantages over the prior art.

Figure 4:
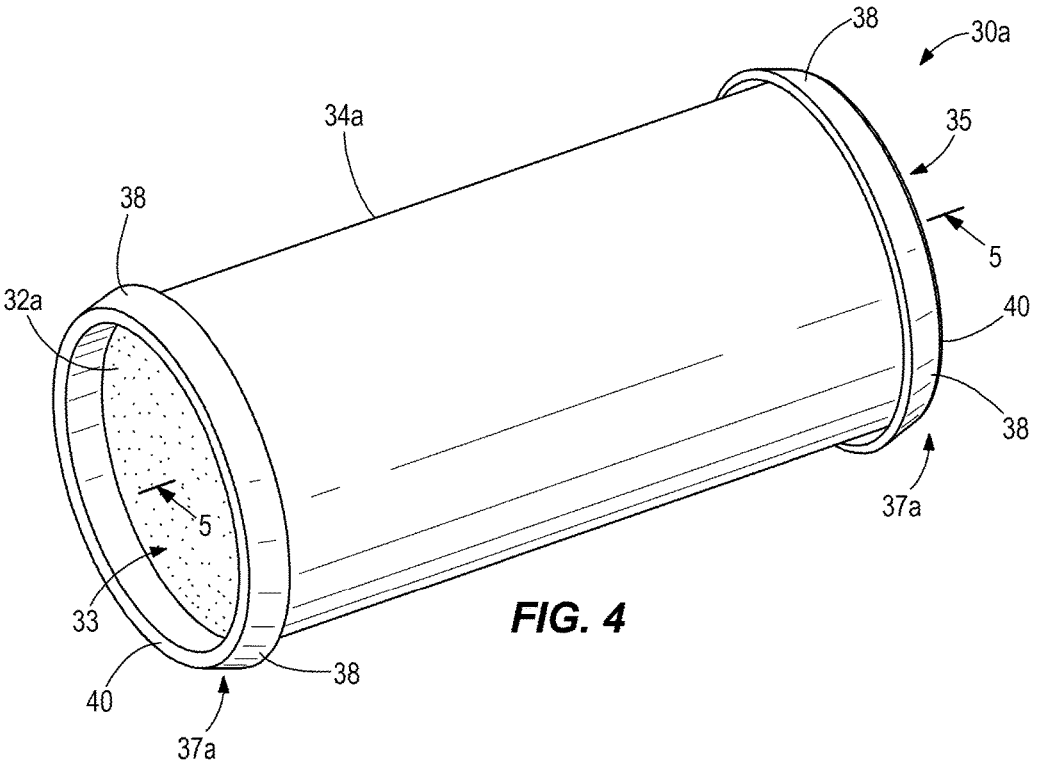
FIG. 4 is a perspective view of a catalyst for treating exhaust in the engine.
Figure 5:
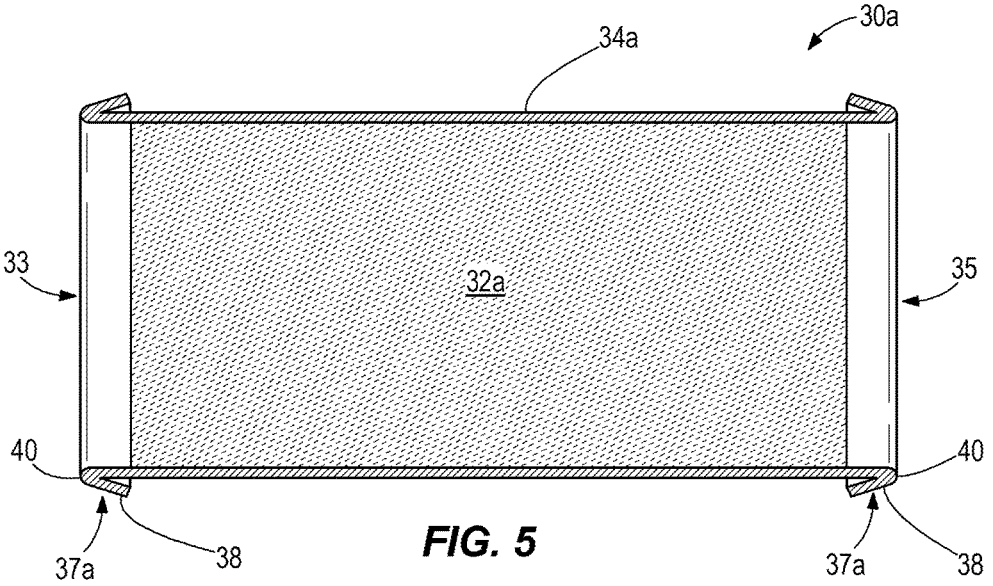
FIG. 5 is a view of section 5-5 taken in FIG. 4.

The particular design of the catalyst 30 can vary. Another example is shown in FIGS. 4 and 5. In this example, catalyst 30*a* includes a metallic or ceramic element 32*a* that is contained in a cylindrical container 34*a*, which radially surrounds the element 32*a*. In some cases the metallic element 32*a* is made of thin foils that are brazed into the container 34*a*. Circumferential protuberances 37*a* are formed on the opposite ends 33, 35 of the container 34*a*. The protuberances 37*a* are sized and shaped such that when the catalyst 30*a* is sandwiched between the respective cavities on the driveshaft housing 16 and crankcase 18, the protuberances 37*a* prevent contact between the respective cavities and the remaining radially outer surfaces of the container 34*a* (i.e. the surfaces of the container other than the protuberances). Thus the protuberances 37*a* effectively separate the remaining surface of the container 34*a* from the crankcase 18 and driveshaft housing 16 so that an air gap 39 exists there between. The protuberances 37*a* also form circumferential seals with the cavities of the crankcase 18 and driveshaft housing 16 when the catalyst 30*a* is sandwiched there between. The seals advantageously prevent exhaust gases from bypassing the element 32 of the catalyst 30*a* as the exhaust gases flow from upstream to downstream through the second flow passage 28. In this example, each protuberance 37*a* is formed by a circumferential flange 38 on a respective end 33, 35 of the container 34*a*. The flange 38 is formed by a folded end 40 of the container 34.

Through research and experimentation, the present inventors have determined that the designs shown and described herein are easier to assemble than the prior art arrangements wherein a catalyst is axially inserted into a manifold and retained at one end by a flange. Instead, the catalyst 30*a* is radially retained when the castings 16, 18 are clamped together. The air gap advantageously insulates the container 34*a* from the castings, which typically are water-cooled. This prevents the catalyst 30*a* from becoming over-cooled. The seals formed by the protuberances 37*a* advantageously prevent exhaust gases from passing around the periphery of the container 34*a*, thus maximizing the effects of the catalyst 30*a*. Also, contact between the protuberances 37*a* provides a way for heat to transfer out of the catalyst 30*a* and into the castings 16, 18 in a controlled manner, thus providing better control of catalyst temperature. The protuberances 37*a* provide the radial pressure to retain the catalyst 30*a* in place.

Figure 6:
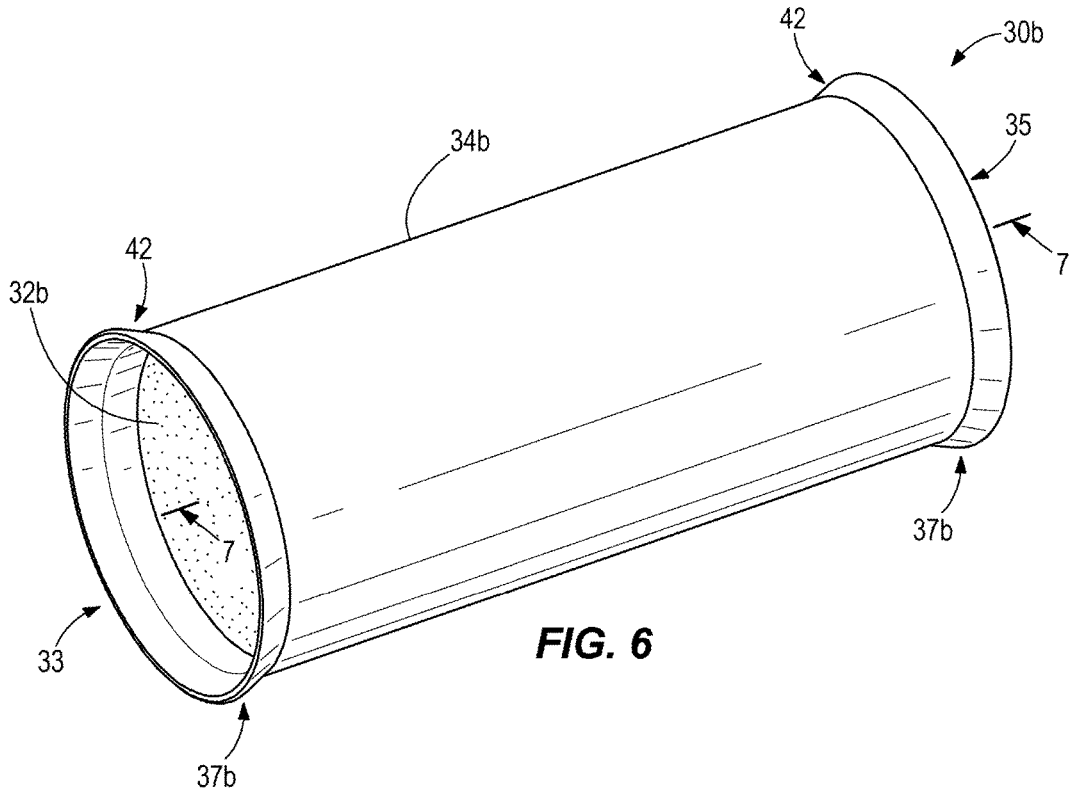
FIG. 6 is a perspective view of another example of a catalyst for treating exhaust from the engine.
Figure 7:
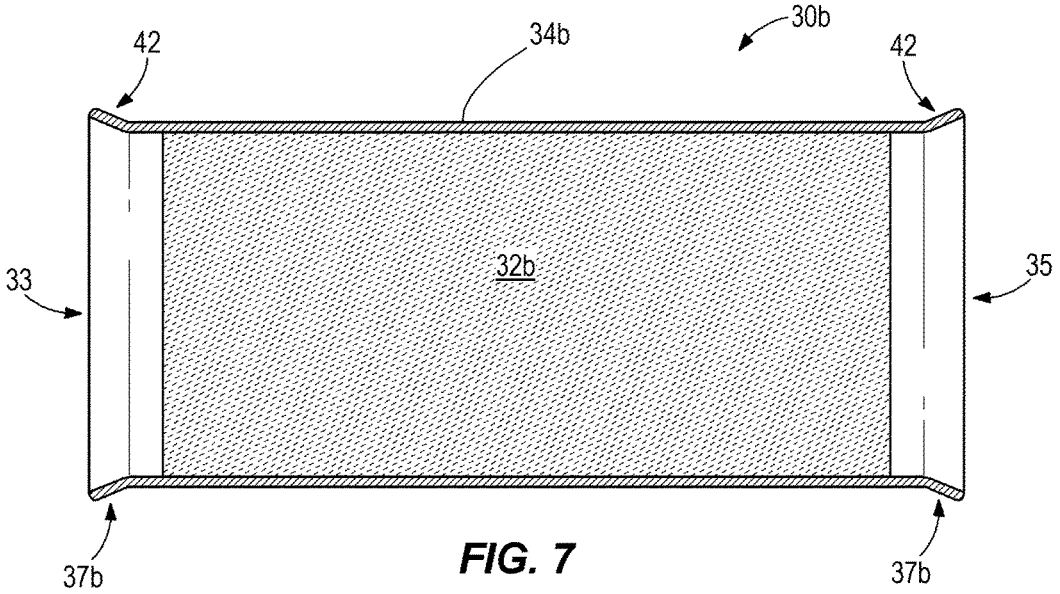
FIG. 7 is a view of section 7-7 taken in FIG. 6.

FIGS. 6 and 7 depict another example of a catalyst 30*b*. The catalyst 30*b* is the same as the catalyst 30*a* except that the circumferential protuberances 37*b* are formed by circumferentially flared ends 42 of the container 34*b*. The circumferential protuberances 37*b* also form the noted circumferential seals and define the air gap. The same advantages discussed regarding the catalyst 30*a* are provided by the catalyst 30*b*.

Figure 8:
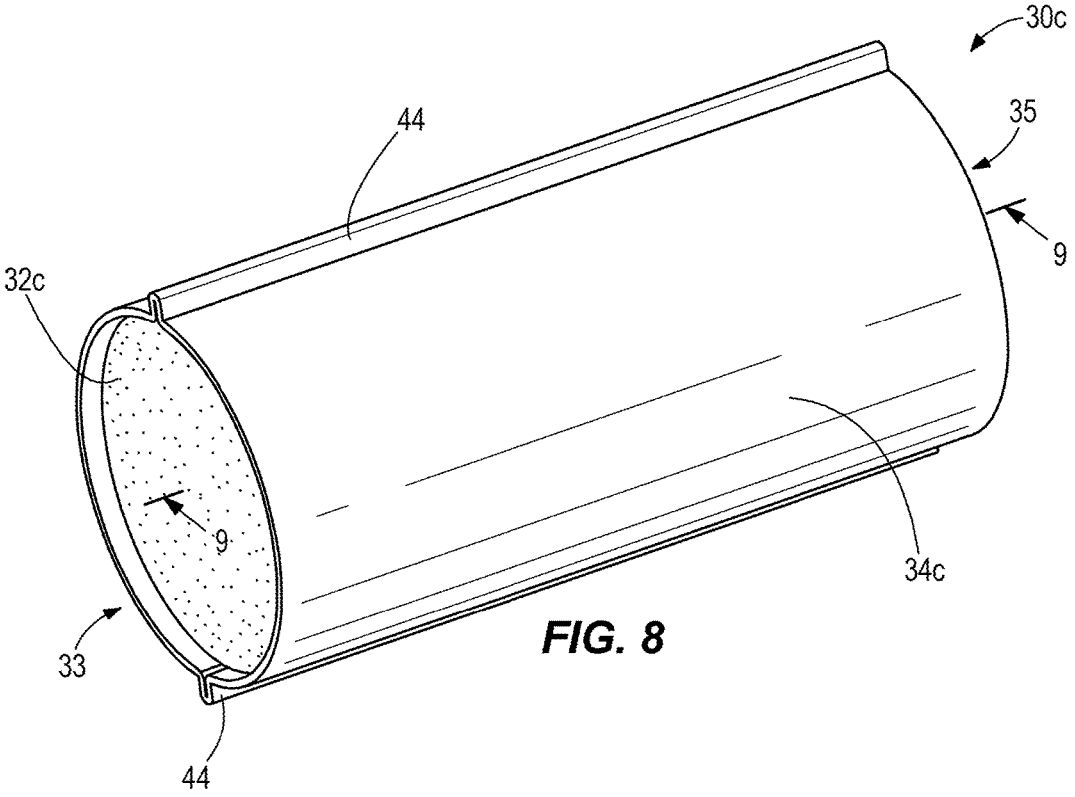
FIG. 8 is a perspective view of another example of a catalyst for treating exhaust from the engine.
Figure 9:
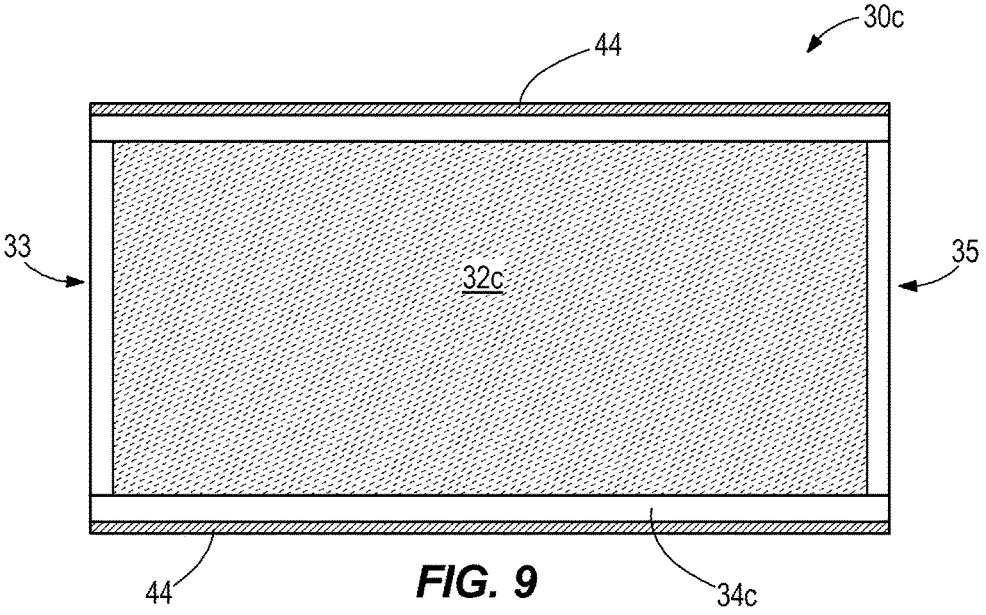
FIG. 9 is a view of section 9-9 taken in FIG. 8.

FIGS. 8 and 9 show another example of a catalyst 30*c*. Catalyst 30*c* includes a metallic or ceramic element 32*c* that is contained in a cylindrical container 34*c*, which radially surrounds the element 32*c*. The container 34*c* has opposing longitudinal flanges 44 that each extends from the upstream end 33 to the downstream end 35. During assembly, the flanges 44 are sandwiched between the driveshaft housing 16 and crankcase 18 so that a longitudinal seal is formed between the flanges 44 and the driveshaft housing 16 and crankcase 18. The seal extends from the upstream end 33 to the downstream end 35. In this example, the flanges 44 are formed by folded portions of the container 34*c*; however the flanges could instead be formed by opposite longitudinally aligned edges of the container 34 or by a separate piece of container or other material. The present inventors have found that by providing the flange 44 that is sandwiched between the castings 16, 18, the catalyst 30*c* is effectively retained.

The present inventors have realized that these and other catalyst designs are also possible within the scope of this disclosure. For example the container 34 could include a raised bead, like on a metal gasket, which could be sized and shaped to retain the catalyst in a manner similar to the examples described herein above. Alternately, a straight-edged container could be provided and an extra piece of container material installed over the can to provide a mounting feature—in a two-piece retention feature.

It will thus be seen that the present disclosure provides a marine propulsion device 10 having an internal combustion engine 12 that discharges exhaust gases. A driveshaft housing 16 is located vertically below the engine 12. A catalyst 30, 30*a*, 30*b*, 30*c* is sandwiched between opposing castings (here the driveshaft housing 16 and a crankcase 18) which face each other at a split-line 29. The exhaust gases flow through the catalyst 30, 30*a*, 30*b*, 30*c* parallel to the split-line 29 and are discharged to the driveshaft housing 16. The catalyst 30, 30*a*, 30*b*, 30*c* is radially compressed between the noted opposing castings. In certain examples, the catalyst comprising a ceramic element and a matting material that surrounds the ceramic element. In other examples, the catalyst comprising a ceramic or metallic element and a cylindrical container that contains the element such that an air gap exists between the container and the opposing castings. A circumferential protuberance (such as 37*a*, 37*b*) is on the container and separates the container from the opposing casting so as to define a air gap, form a circumferential seal with the opposing castings, prevent exhaust gas from bypassing the element, and provide radial pressure to retain the catalyst in place. In other examples, a longitudinal flange, such as 44, is on the container and is sandwiched between the opposing castings.

Through research and experimentation, the present inventors have also determined that in order to develop a cost-effective engine with an integrated catalyst housing, a die-cast production process is preferred. However the limitations of the die casting process lead to sharp inside corners/edges of exhaust passages, wherein the exhaust gas flow has to make a sharp turn, such as 90 degrees. The inventors have determined that such sharp inside corners/edges can create an uneven or poorly distributed flow of exhaust gases to the upstream end 33 of the catalyst. Through research and experimentation, the present inventors have determined that exhaust flow around sharp corners/edge tends to get choked and may not disperse evenly across the front face of the catalyst. This can result in an inefficient use of the catalyst, wherein only a certain, relatively small percentage of the catalyst receives exhaust flow.

To counteract this problem, the exemplary engine 12 shown in FIGS. 1-3 includes a flow control element 54 located at a junction between the first leg of the second flow passage and the second leg of the second flow passage. The flow control element 54 forms a smooth transition 56 at the junction between the passages where there otherwise would be a sharp corner/edge. The smooth transition 56 is devoid of edges. Through testing, the inventors have determined that because of the smooth transition 56, the exhaust gases tend to flow more evenly through the junction and disperse more evenly across the upstream end 33 of the catalyst 30. The present inventors have discovered that because of the above-noted limitations of the die casting process, it was not cost effective to form the flow control element 54 having the smooth transition during the die casting process for the major castings 16, 18. Instead, the exemplary engine 12 includes the flow control element 54 as part of an intermediate plate 58 that is sandwiched between the crankcase 18 and the cylinder head 22. Thus the exhaust gases flow from upstream to downstream across the smooth transition 56 and are dispersed before flowing through the catalyst 30. In this example, the shape of the intermediate plate 58 is formed such that the exhaust gas flows through one or more holes 60 formed in the intermediate plate 58. However it should be noted that the intermediate plate 58 could have a different shape, and in fact the flow control element 54 does not have to be attached to an intermediate plate, but could instead be a separate piece by itself and attached by any conventional fastening mechanism to, for example, the cylinder head 22 or crankcase 18.

It will thus be seen that the present disclosure provides a marine propulsion device 10 having an internal combustion engine 12 that discharges exhaust gases. The internal combustion engine has first and second castings. In some examples the second casting is diecast. In some examples, the first and second castings are the cylinder head 22 and the crankcase 16, respectively. A first exhaust flow passage 26 is formed in the first casting 22 and a second exhaust flow passage 28 is formed in the second casting 16. The second exhaust flow passage has an upstream first leg that is parallel to the first flow passage, and a downstream second leg that is transversely oriented to the first leg. A catalyst 30, 30*a*, 30*b*, 30*c* is disposed in the second exhaust flow passage 28 and configured to treat the exhaust gases. A flow control element 54 is located between the first leg of the second exhaust flow passage and second leg of the second exhaust flow passage and forms a smooth transition that is devoid of edges such that the exhaust gases flow across and are dispersed by the flow control element 54 before being treated by the catalyst 30, 30*a*, 30*b*, 30*c*. The intermediate plate 58 carries the flow control element 54 and is sandwiched between the noted first and second castings. The plate 58 is configured so that the exhaust gases flow through a hole 60 in the plate. In this example, the flow control element 54 laterally extends into the first leg of the second exhaust flow passage 26. In this particular example, the flow control element 54 includes an extension on the plate that has a first planar surface 70 that abuts the second casting and a second planar surface 72 that is parallel to the first planar surface 70 and that faces the first leg of the second exhaust flow passage 26. A curved outer transition surface 74 connects the first and second planar surfaces 70, 72. The curved outer transition surface 74 is devoid of edges. A notch 76 is disposed between the first planar surface 70 and the curved outer transition surface 74. The notch 76 faces the catalyst 30, 30*a*, 30*b*, 30*c*.

Figure 12:
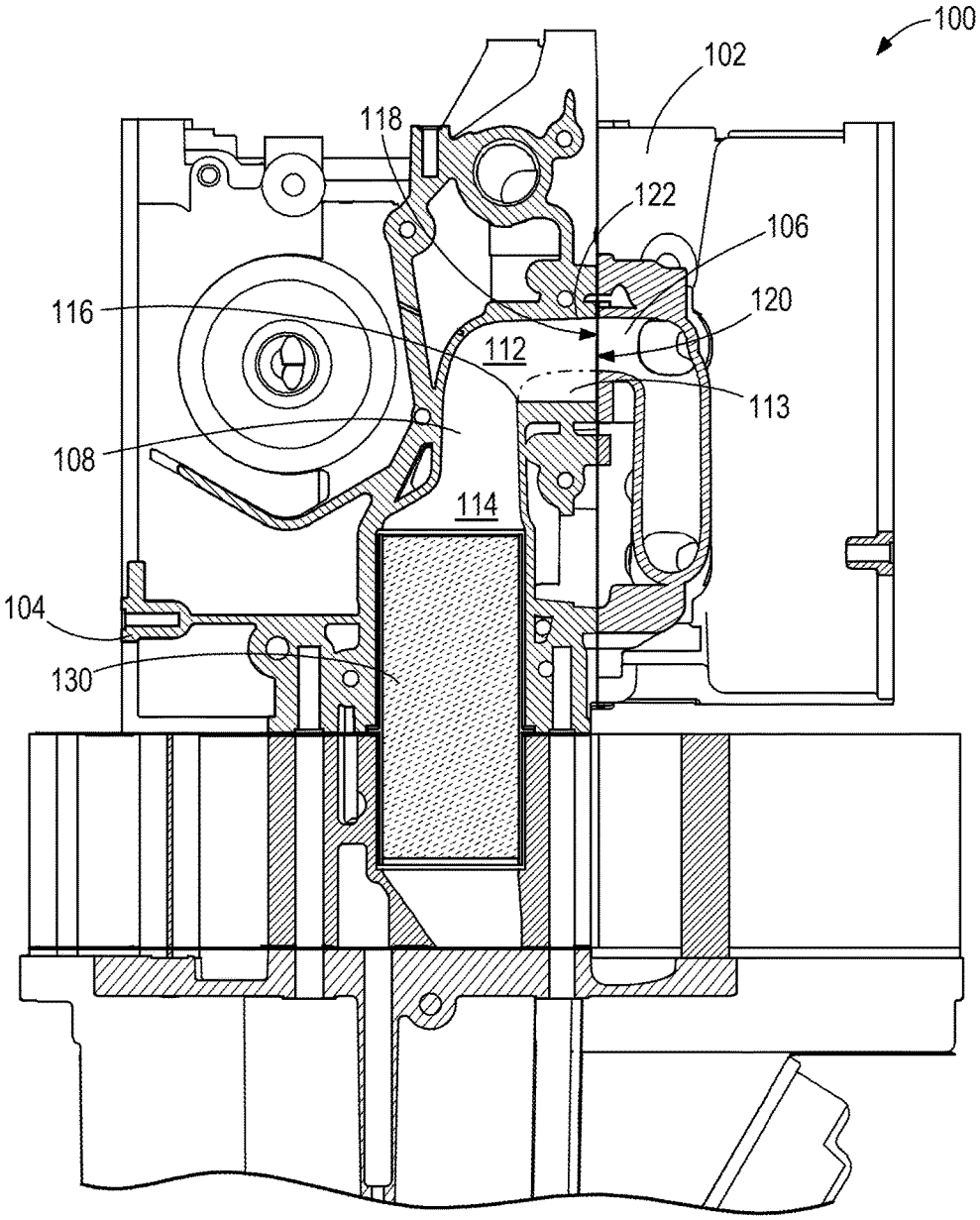
FIG. 12 is another example of an internal combustion engine for a marine propulsion device.

The present inventors have also realized an additional way in which to overcome the drawbacks associated with sharp corners/edges in flow paths through castings. FIG. 12 depicts another example of an internal combustion engine 100, having a first engine casting 102 that is adjacent a second engine casting 104. The first engine casting 102 defines a first flow passage 106 configured to receive exhaust gases from, for example the piston-cylinder. The second engine casting 104 that defines a second flow passage 108 configured to receive exhaust gases from the first flow passage 106 and convey the exhaust gases to a catalyst 130. The second flow passage 108 has an upstream first leg 112 that is parallel to the first flow passage 106 and a downstream second leg 114 that is transversely oriented to the first leg 112. An inside corner edge 116 is between the first and second legs 112, 114. The first leg 112 of the second flow passage 108 has an inlet end 118 that is configured to receive exhaust gases from the first flow passage 106. The first flow passage 106 has an outlet end 120 that is configured to convey exhaust gases to the inlet end 118 of the first leg 112 of the second flow passage 108. Ordinarily the inside corner edge 116 would disrupt flow of exhaust gases and cause inefficiency of the catalyst 110; however in this example the outlet end 120 of the first flow passage 106 is sized smaller than the inlet end 118 of the first leg 112 of the second flow passage 108 so that exhaust gases are directed away from the inside corner edge 116 as the exhaust gases travel from the outlet end 120 of the first flow passage 106 to the inlet end 118 of the first leg 112 of the second flow passage 108. The inlet end 118 of the second flow passage 108 is sized large enough so that the inside corner edge 116 is spaced away from and does not disrupt the exhaust flow. Instead, the exhaust flow advantageously follows a path as if there was a side wall 113 located in the second flow passage 108. In this example, the first engine casting 102 is a cylinder head and the second engine casting 104 is a cylinder block; however this is merely exemplary and the type of casting could vary. In this example, the second leg 114 of the second flow passage 108 is oriented at 90 degrees from the first leg 112 of the second flow passage 108; however this is merely exemplary and the angle could vary.

It will thus be seen that the present disclosure provides an internal combustion engine 100 for a marine propulsion device. The engine 100 includes a piston-cylinder that discharges exhaust gases, a first engine casting 102 that defines a first flow passage 106 configured to receive the exhaust gases from the piston-cylinder, and a second engine casting 104 that defines a second flow passage 108 configured to receive the exhaust gases from the first flow passage and convey the exhaust gases to a catalyst 130. The second flow passage 108 has an upstream first leg 112 that is parallel to the first flow passage 106 and a downstream second leg 114 that is transversely oriented to the first leg 112. An inside corner 116 is disposed between the first and second legs 112, 114. The second flow passage 108 has an inlet end 118 that is configured to receive the exhaust gases from the first flow passage 106. The first flow passage 106 has an outlet end 120 that is configured to convey exhaust gases to the inlet end 118 of the second flow passage 108. The outlet end 120 is sized smaller than the inlet end 118 so that exhaust gases are directed away from the inside corner 116 as the exhaust gases travel from the outlet end 120 to the inlet end 118. In the example shown, the first engine casting is a cylinder head and the second engine casting is a cylinder block. The second leg 114 of the second flow passage 108 is oriented at 900 from the first leg 116 of the first flow passage 106. The catalyst 130, 130*a*, 130*b*, 130*c* is disposed in the second flow passage 1080 and is configured to treat the exhaust gases. In this arrangement, the first and second flow passage 106, 108 together form a smooth outside radius 122 along which the exhaust gases travel, away from the corner 12. The inlet end 118 is sized larger than the outlet end 120 so that the corner 116 is located away from the flow of exhaust gases, wherein the corner 116 does not disrupt the flow of the exhaust gases. In this manner, a stagnant zone 113 is formed immediately downstream of the outlet end 120, and the exhaust gases tend to bypass the stagnant zone 113.

A method of forming the above noted internal combustion engine includes die casting the second engine casting having the first and second leg of the second exhaust flow passage, as described herein above.

In the present description, certain terms have been used for brevity, clearness, and understanding. No unnecessary limitations are to be inferred therefrom beyond the requirement of the prior art because such terms are used for descriptive purposes only and are intended to be broadly construed. The different apparatuses described herein may be used alone or in combination with other apparatuses. Various equivalents, alternatives, and modifications are possible within the scope of the appended claims.

What is claimed is:

1. A marine propulsion device comprising:

an internal combustion engine that discharges exhaust gases, the internal combustion engine comprising first and second engine castings;

a first exhaust flow passage in the first casting and a second exhaust flow passage in the second casting;

wherein the second flow passage has an upstream first leg that is parallel to the first flow passage, and a downstream second leg that is transversely oriented to the first leg;

a catalyst disposed in the second exhaust flow passage and configured to treat the exhaust gases; and a flow control element between the upstream first leg and downstream second leg, the flow control element forming a smooth transition that is devoid of edges such that the exhaust gases flow across and are dispersed by the flow control element before being treated by the catalyst;

wherein the engine comprises a crankcase, a cylinder block, and a cylinder head;

a driveshaft housing that is located vertically below the engine;

wherein the cylinder block has at least one piston-cylinder and wherein the cylinder head has at least one exhaust outlet that is configured to discharge the exhaust gases from the piston-cylinder;

wherein the first exhaust flow passage is formed in the cylinder head and wherein the second exhaust flow passage is formed by the crankcase and the driveshaft housing; and wherein the flow control element comprises an extension having a first planar surface that abuts the second casting, a second planar surface that is parallel to the first planar surface and that faces the first exhaust flow passage, and a curved outer transition surface that connects the first and second planar surfaces, the curved outer transition surface being devoid of edges.

2. The device according to claim 1, wherein the second casting is die-cast.

3. The device according to claim 1, wherein the first engine casting is the cylinder head and wherein the second engine casting is the crankcase.

4. The device according to claim 1, wherein the first exhaust flow passage vertically extends with respect to the engine and wherein the second exhaust flow passage horizontally extends with respect to the engine.

5. A marine propulsion device comprising:

an internal combustion engine that discharges exhaust gases, the internal combustion engine comprising first and second engine castings;

a first exhaust flow passage in the first casting and a second exhaust flow passage in the second casting;

wherein the second flow passage has an upstream first leg that is parallel to the first flow passage, and a downstream second leg that is transversely oriented to the first leg;

a catalyst disposed in the second exhaust flow passage and configured to treat the exhaust gases; and a flat olate having a flow control element between the upstream first leg and downstream second leg, the flow control element forming a smooth transition that is devoid of edges such that the exhaust gases flow across and are dispersed by the flow control element before being treated by the catalyst; and wherein the plate is sandwiched between the first and second engine castings.

6. The device according to claim 5, wherein the flat plate is configured so that the exhaust gases flow through a hole in the plate.

7. The device according to claim 5, wherein the flow control element laterally extends into the upstream first leg.

8. The device according to claim 5, wherein the first and second engine castings face each other at a split-line and wherein the flat plate extends along the split-line between the first and second engine castings.

9. The device according to claim 5, wherein the flow control element comprises an extension on the flat plate, the extension having a first planar surface that abuts the second casting, a second planar surface that is parallel to the first planar surface and that faces the first exhaust flow passage, and a curved outer transition surface that connects the first and second planar surfaces, the curved outer transition surface being devoid of edges.

10. The device according to claim 9, further comprising a notch between the first planar surface and the curved outer transition surface, wherein the notch faces the catalyst.

11. A marine propulsion device comprising:

an internal combustion engine that discharges exhaust gases;

a die-cast driveshaft housing that is located vertically below the engine;

wherein the engine comprises a die-cast crankcase, die-cast cylinder block, and a cylinder head, wherein the cylinder block has at least one piston-cylinder, and wherein the cylinder head has at least one exhaust outlet that is configured to discharge the exhaust gases from the piston-cylinder;

a first exhaust flow passage in the cylinder head and a second exhaust flow passage formed between the crankcase and the driveshaft housing, wherein the second exhaust flow passage has an upstream first leg that is parallel to the first flow passage, and a downstream second leg that is transversely oriented to the first leg;

a catalyst disposed in the second exhaust flow passage and configured to treat the exhaust gases;

a flow control element between the upstream first leg and the downstream second leg, the flow control element forming a smooth transition that is devoid of edges such that the exhaust gases flow across and are dispersed by the flow control element before being treated by the catalyst; and wherein the flow control element comprises an extension having a first planar surface that abuts the second casting, a second planar surface that is parallel to the first planar surface and that faces the first exhaust flow passage, and a curved outer transition surface that connects the first and second planar surfaces, the curved outer transition surface being devoid of edges.

12. The device according to claim 11, further comprising a flat plate that carries the flow control element, wherein the plate that is sandwiched between the engine block and the crankcase, wherein the flow control element extends into the upstream first leg, wherein engine block and the crankcase face each other at a split-line, and wherein the flat plate extends along the split-line.

* * * * *